US009162811B2

(12) United States Patent
Schneider et al.

(10) Patent No.: US 9,162,811 B2
(45) Date of Patent: Oct. 20, 2015

(54) KNIFE BLADE DISPENSER

(71) Applicant: Milwaukee Electric Tool Corporation, Brookfield, WI (US)

(72) Inventors: Daniel H. Schneider, Franklin, WI (US); Steven W. Hyma, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 249 days.

(21) Appl. No.: 13/679,305

(22) Filed: Nov. 16, 2012

(65) Prior Publication Data

US 2013/0126550 A1 May 23, 2013

Related U.S. Application Data

(60) Provisional application No. 61/561,110, filed on Nov. 17, 2011.

(51) Int. Cl.

| | |
|---|---|
| ***G07F 11/16*** | (2006.01) |
| ***B65G 59/00*** | (2006.01) |
| ***B65H 3/00*** | (2006.01) |
| ***B65D 83/10*** | (2006.01) |

(52) U.S. Cl.

CPC ..... *B65D 83/10* (2013.01)

(58) Field of Classification Search

CPC ..... B65D 83/10

USPC ..... 221/48, 1, 256, 270, 255, 231; 206/531, 206/538

See application file for complete search history.

(56) References Cited

U.S. PATENT DOCUMENTS

| | | | | |
|---|---|---|---|---|
| 489,069 | A | | 1/1893 | Crook |
| 1,171,478 | A | | 2/1916 | Tintera |
| 1,652,685 | A | | 12/1927 | Schick |
| 1,791,586 | A | * | 2/1931 | Todd ..... 206/355 |
| 1,911,627 | A | | 5/1933 | Lashar |
| 2,043,046 | A | | 6/1936 | Kuhnl |
| 2,080,038 | A | | 5/1937 | Fredrickson |
| 2,182,615 | A | | 12/1939 | Johnson |
| 2,272,444 | A | | 10/1940 | Testi |
| 2,321,570 | A | | 6/1943 | Billing |
| 2,418,677 | A | | 4/1947 | Testi |
| 2,472,051 | A | | 5/1949 | Testi |
| 2,641,358 | A | | 6/1953 | Santo |
| 2,792,933 | A | | 5/1957 | Butlin |
| 2,889,076 | A | | 6/1959 | Van Schie |
| 3,115,991 | A | | 12/1963 | Carew et al. |
| 3,502,203 | A | | 3/1970 | Braginetz |
| 3,542,245 | A | * | 11/1970 | Braginetz ..... 221/232 |
| 3,650,433 | A | * | 3/1972 | Robertson ..... 221/65 |
| 3,827,597 | A | | 8/1974 | Braginetz |
| 3,850,343 | A | | 11/1974 | Petrillo |
| 3,864,896 | A | | 2/1975 | Bailey, Jr. |

(Continued)

*Primary Examiner* — Rakesh Kumar

(74) *Attorney, Agent, or Firm* — Michael Best & Friedrich LLP

(57) ABSTRACT

A knife blade dispenser including a plurality of knife blades, a frame, a cover coupled the frame to define a storage volume between the cover and the frame for the plurality of knife blades, a spacer assembly positioned within the storage volume to separate the storage volume into a new knife blade region for the plurality of knife blades to be stored and a used knife blade region configured to store a plurality of used knife blades that is in communication with the used blade slot, and a shuttle to dispense at least one of the plurality of knife blades from within the storage volume.

10 Claims, 10 Drawing Sheets

(56) References Cited

U.S. PATENT DOCUMENTS

| | | | | | |
|---|---|---|---|---|---|
| 3,910,455 | A | | 10/1975 | Ferraro | |
| 3,941,244 | A | | 3/1976 | Braginetz | |
| 4,114,780 | A | | 9/1978 | Sharon | |
| 4,190,420 | A | * | 2/1980 | Covington et al. | 422/63 |
| 4,379,514 | A | * | 4/1983 | Joffe | 221/279 |
| 4,789,080 | A | * | 12/1988 | Iten | 221/279 |
| 4,826,042 | A | * | 5/1989 | Vujovich | 221/228 |
| 4,850,512 | A | * | 7/1989 | Vujovich | 221/232 |
| 4,978,031 | A | | 12/1990 | Lembke | |
| 5,139,167 | A | | 8/1992 | McCarthy | |
| 5,251,783 | A | * | 10/1993 | Gringer | 221/102 |
| 5,388,693 | A | * | 2/1995 | Ceraudo | 206/340 |
| 5,409,133 | A | | 4/1995 | Gringer | |
| D403,954 | S | | 1/1999 | Okada et al. | |
| 6,158,616 | A | * | 12/2000 | Huang | 221/268 |
| D462,861 | S | | 9/2002 | Schmidt | |
| 6,446,802 | B1 | * | 9/2002 | Lutz et al. | 206/354 |
| 6,598,761 | B1 | * | 7/2003 | Chou | 221/228 |
| 6,796,455 | B2 | * | 9/2004 | Schmidt | 221/256 |
| D536,624 | S | | 2/2007 | Novak et al. | |
| 2003/0085236 | A1 | * | 5/2003 | Schmidt | 221/232 |
| 2004/0099682 | A1 | * | 5/2004 | Huang | 221/232 |
| 2004/0178214 | A1 | * | 9/2004 | Wei | 221/247 |
| 2010/0147869 | A1 | | 6/2010 | Iliffe et al. | |

* cited by examiner

KNIFE BLADE DISPENSER

CROSS-REFERENCE TO RELATED APPLICATIONS

This application claims priority to U.S. Provisional Patent Application No. 61/561,110, filed Nov. 17, 2011, the entire contents of which are hereby incorporated by reference herein.

BACKGROUND

The present invention relates to a blade dispenser and, more particularly, to a blade dispenser with storage capacity for used blades.

Knife blades, also referred to as utility blades, are generally used in combination with handles or holders for all-purpose cutting. The blades themselves are oftentimes sold separately from their handle units and can be very dangerous if not handled properly. Blades are generally sold in bulk so that replacement blades are readily accessible when an existing blade breaks or has become worn out. When a blade is no longer useful, it can be difficult to dispose of in a safe manner given the blades ability to remain sharp even after being discarded.

SUMMARY

In one embodiment, the invention provides a knife blade dispenser that includes a frame including a back wall and a bottom wall extending outwardly from the back wall, the bottom wall including a groove and the back wall including a locking detent, cover apertures, and a mounting aperture, the mounting aperture configured to hang the dispenser. The dispenser further including a cover including a plurality of protrusions each extending into one of the cover apertures of the frame to couple the cover to the frame to define a storage volume between the cover and the frame for the plurality of knife blades. The cover further including a trapezoidal end wall and three side walls that extend perpendicularly from a periphery of the end wall, a used blade slot located proximate an intersection of the trapezoidal end wall and one of the three side walls, and a rib that extends along an inside surface of at least one of the three side walls. The dispenser further includes a spacer assembly positioned within the storage volume to separate the storage volume into a new knife blade region for storing a plurality of knife blades and a used knife blade region for storing a plurality of used knife blades that is in communication with the used blade slot, the spacer assembly is movable within in the storage volume along the rib to increase a volume of the used knife blade region while decreasing the volume of the new knife blade region. The dispenser further includes a shuttle to dispense at least one of the plurality of knife blades from within the new knife blade region, the shuttle including a projection received in the groove of the frame to guide sliding movement of the shuttle between a set position where the shuttle is located substantially within the storage volume and a deployed position where the shuttle extends at least partially out of the cover to access one of the plurality of knife blades, the shuttle further including a support surface with a finger notch and a ridge that extends around the support surface, the ridge extends upwardly from the support surface a distance substantially corresponding to a thickness of one of the plurality of knife blades.

Figure 1:
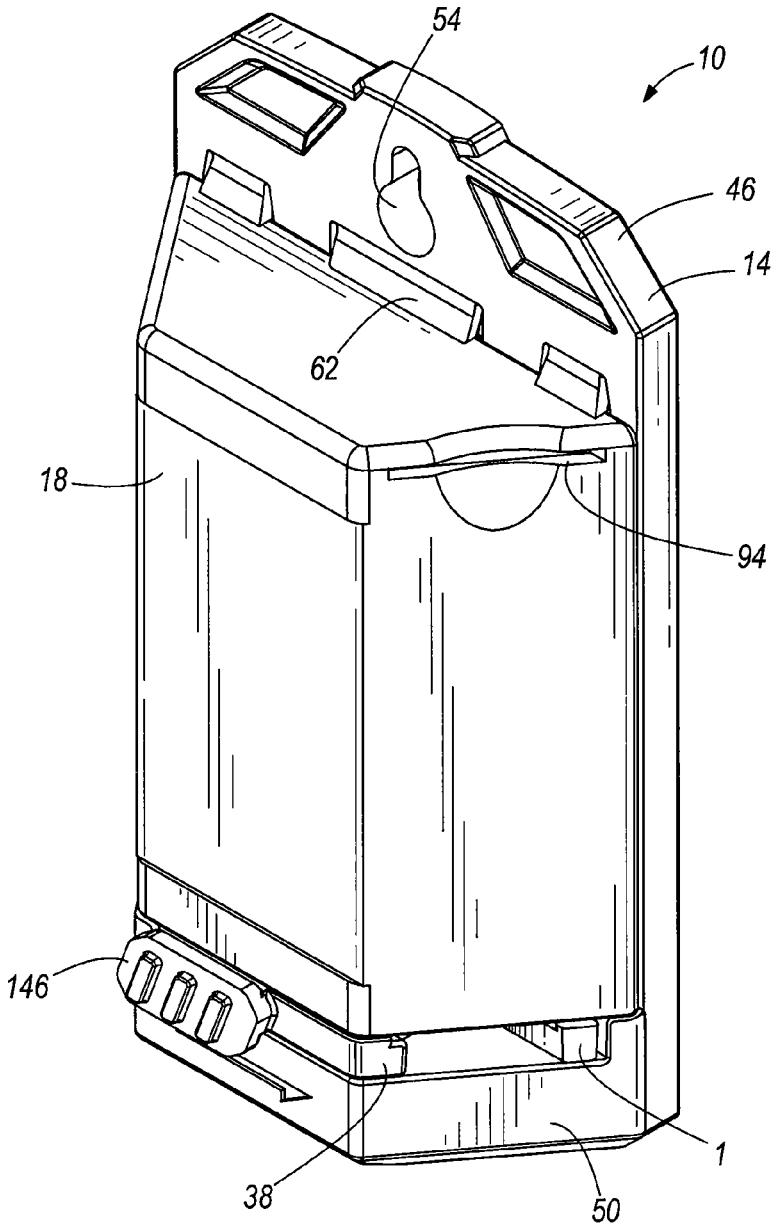
FIG. 1 is a perspective view of a knife blade dispenser according to one construction of the invention.

Before any embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-13 illustrate a knife blade dispenser 10 according to one construction of the invention. The dispenser 10 is used for storing and dispensing new knife blades while providing a separate storage area for used and worn knife blades. The dispenser 10 includes a frame 14, a cover 18 coupled to the frame 14 forming a storage volume 22 (FIG. 2) therebetween, a spacer assembly 26 (FIGS. 6-7) positioned within the storage volume 22, and a shuttle 38 to dispense knife blades 42 positioned within the storage volume 22.

Figure 2:
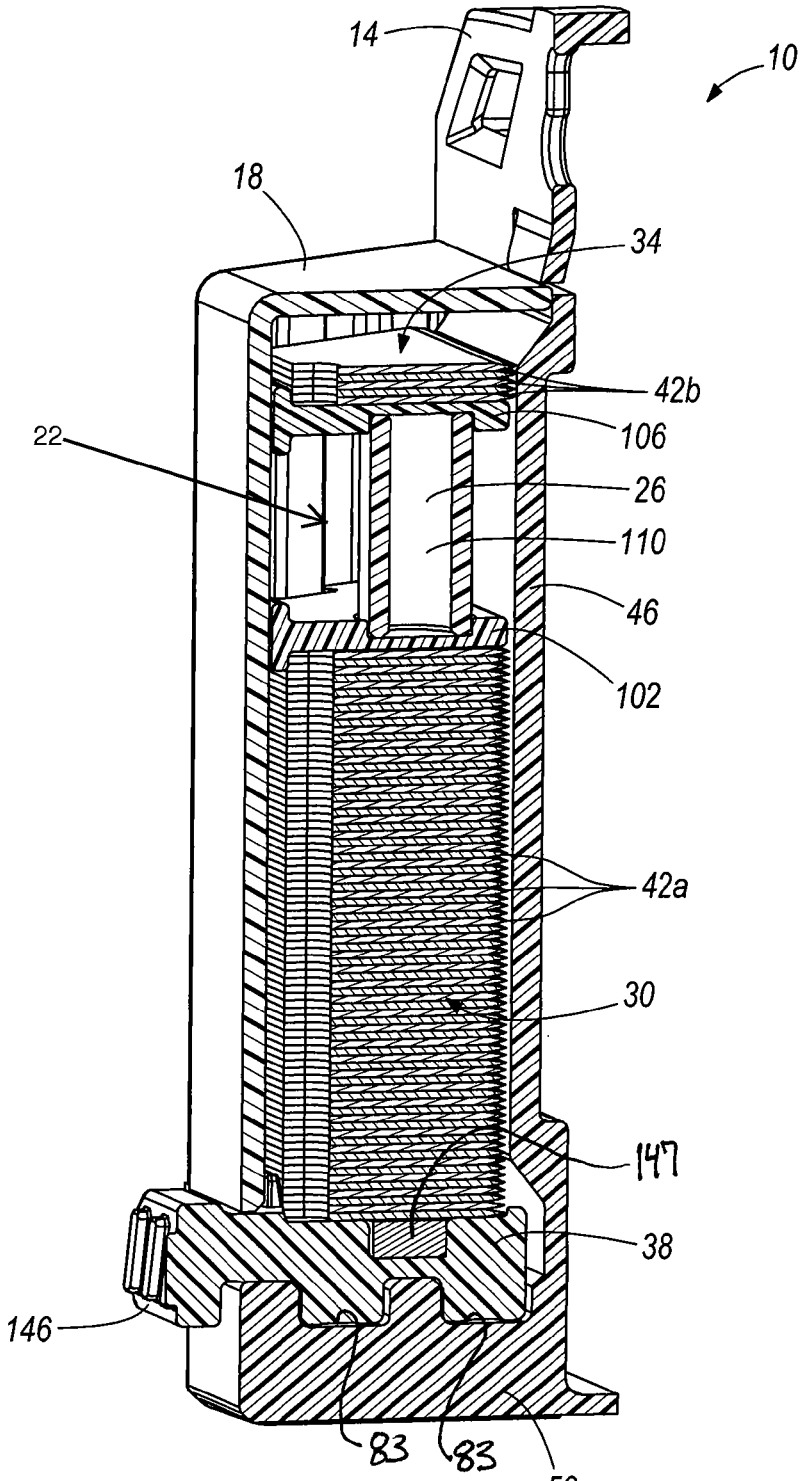
FIG. 2 is a section view of the knife blade dispenser taken along lines 2-2 of FIG. 12.
Figure 3:
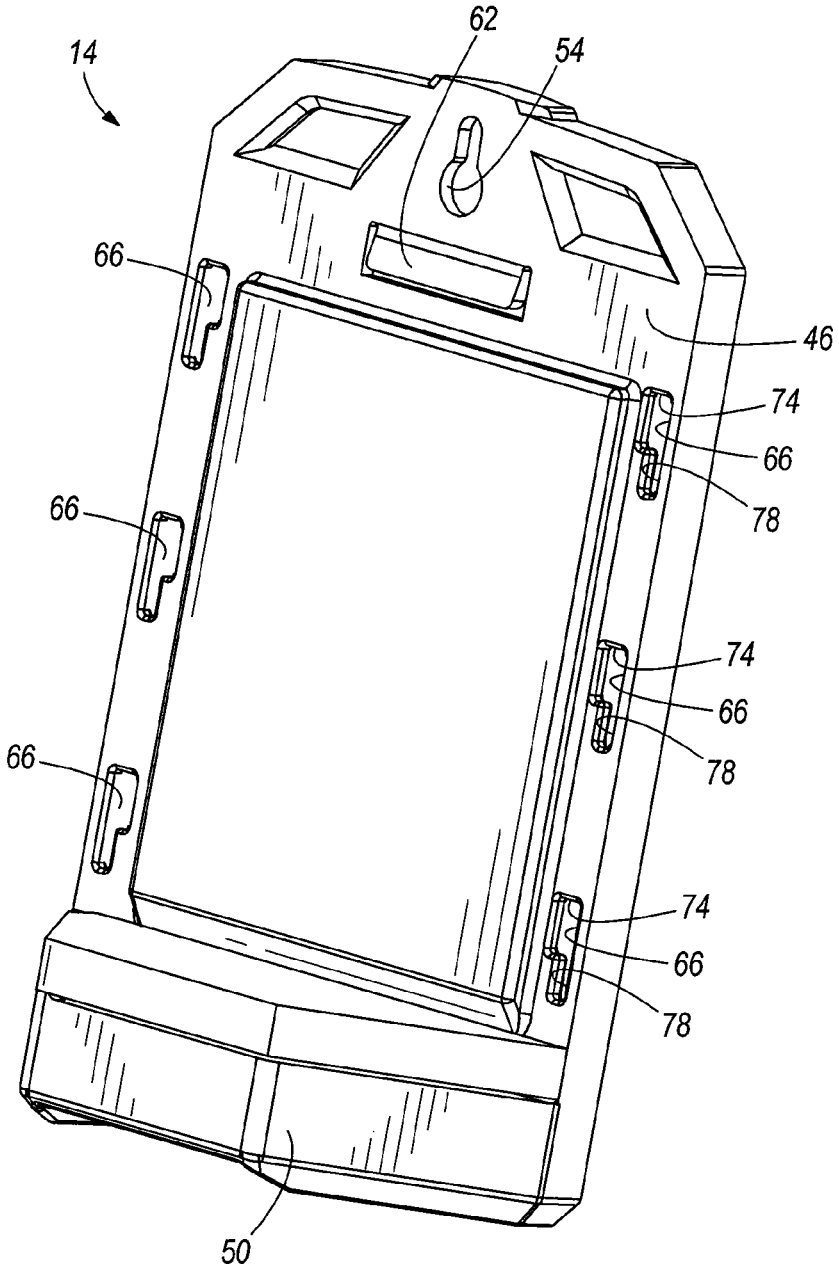
FIG. 3 is a perspective view of a frame of the knife blade dispenser of FIG. 1.

Illustrated in FIGS. 1-3, the frame 14 of the knife blade dispenser 10 is substantially "L" shaped and includes a back wall 46 and a bottom wall 50 extending outwardly from the back wall 46 to define a pair of grooves 83. The back wall 46 of the frame 14 is generally formed as a flat rectangular plate that defines a mounting aperture 54 (e.g., a keyhole slot) opposite the bottom wall 50 for hanging the dispenser 10 from a wall or other vertical surface. The back wall 46 also includes a locking detent 62 that, when the dispenser 10 is assembled, secures the cover 18 to the back wall 46.

The back wall 46 also defines apertures 66 (e.g., six), each positioned generally along a side edge of the back wall 46 and sized to receive a corresponding protrusion 70 (described below) of the cover 18 therein. In the illustrated construction, each aperture 66 is substantially "L" shaped and includes a large end 74 and a small end 78.

Figure 4:
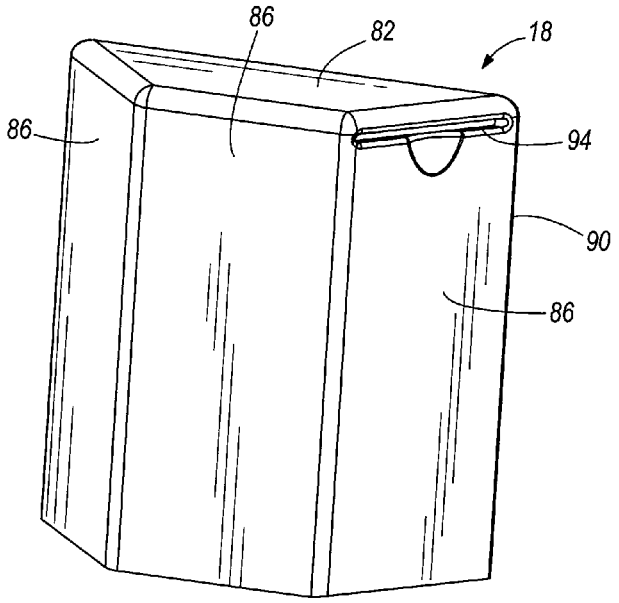
FIG. 4 is a perspective view of a cover of the knife blade dispenser of FIG. 1.
Figure 5:
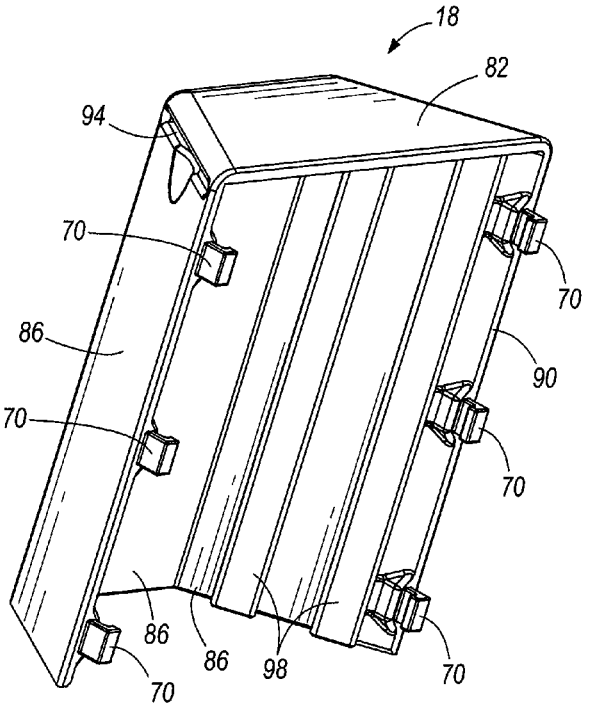
FIG. 5 is a rear perspective view of the cover of FIG. 4.

Illustrated in FIGS. 4 and 5, the cover 18 of the knife blade dispenser 10 includes a substantially trapezoidal end wall 82 and three side walls 86, each extending substantially perpendicularly from a periphery of the end wall 82 to form a substantially trapezoidal-prism shape. In the illustrated construction, a contacting edge 90 of the cover 18 includes L-shaped protrusions 70 (e.g., six), each sized to be at least partially received within a corresponding one of the apertures 66 formed in the frame 14. Although the illustrated cover 18 is substantially trapezoidal in cross-section to correspond with the substantially trapezoidal shape of the knife blades 42 stored therein, in other constructions the cover 18 may be rectangular, triangular, and the like.

The cover 18 also defines a slot 94 formed proximate an intersection of the end wall 82 and a respective one of the side walls 86. The slot 94 is sized to allow the user to pass a knife blade therethrough and, when the dispenser 10 is assembled, provide outside access into a second region 34 of the storage volume 22 to dispose of old and worn out blades.

The cover 18 also includes ribs 98 (FIG. 5) extending along an inside surface of at least one of the side walls 86. When assembled, the ribs 98 help stabilize the spacer assembly 26 as it moves within the storage volume 22 during use. In the illustrated construction, the cover 18 includes a pair of ribs 98 formed on one wall 86 of the cover 18. However, in other constructions additional ribs 98 may be included as necessary.

Figure 6:
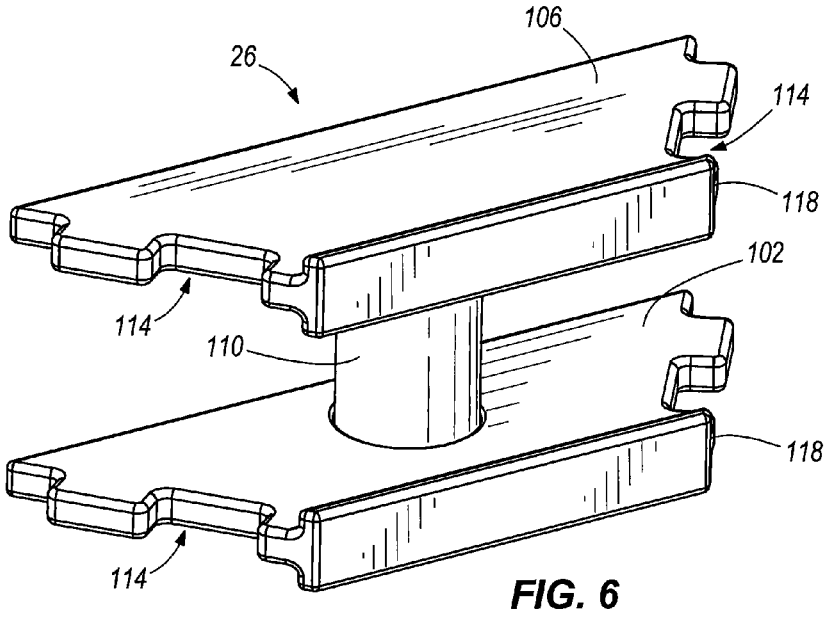
FIG. 6 is a perspective view of a spacer assembly of the knife blade dispenser of FIG. 1.
Figure 7:
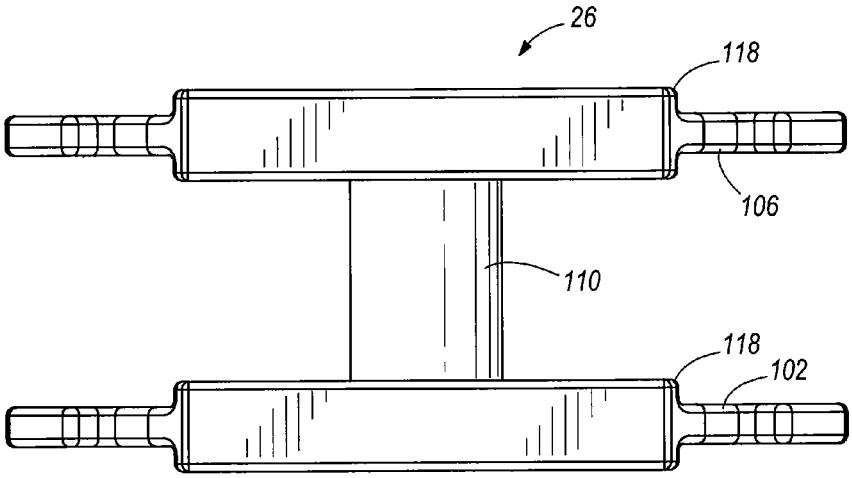
FIG. 7 is a front view of the spacer assembly of FIG. 6.
Figure 8:
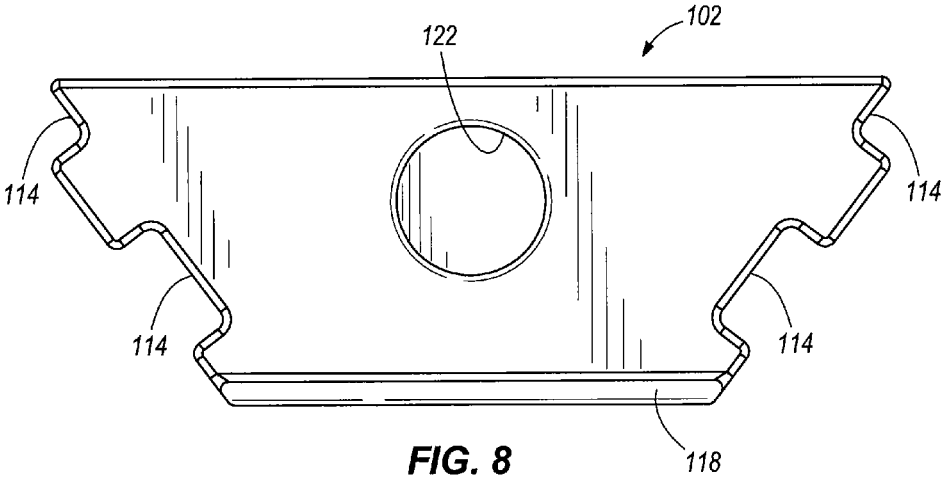
FIG. 8 is a top view of an end plate of the spacer assembly of FIG. 6.
Figure 9:
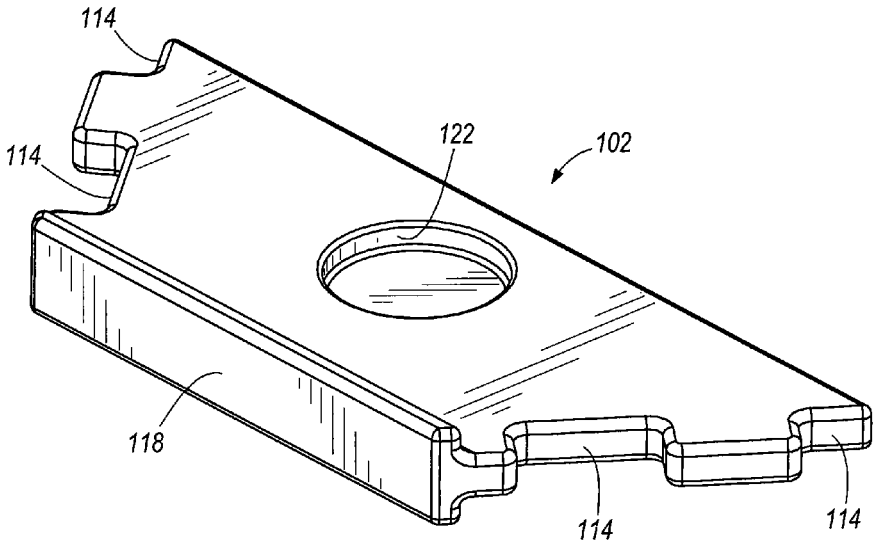
FIG. 9 is a perspective view of the end plate of FIG. 8.
Figure 10:
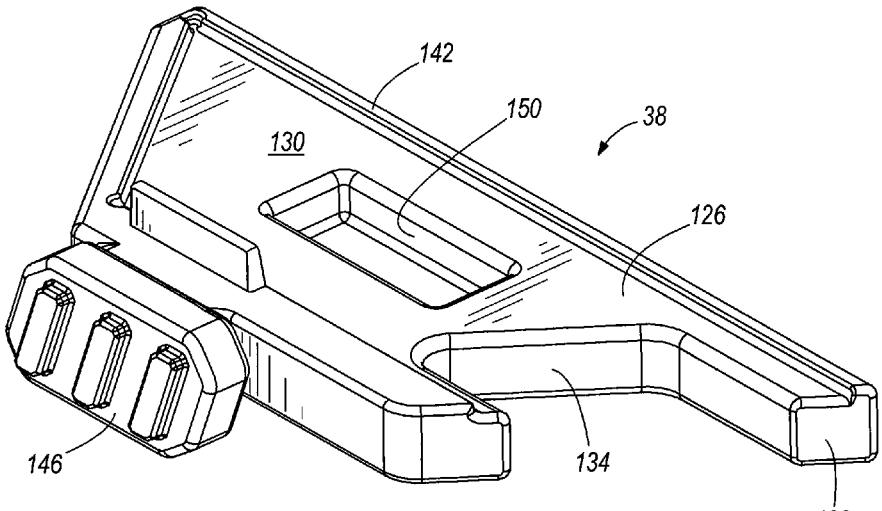
FIG. 10 is a perspective view of a shuttle of the knife blade dispenser of FIG. 1.
Figure 11:
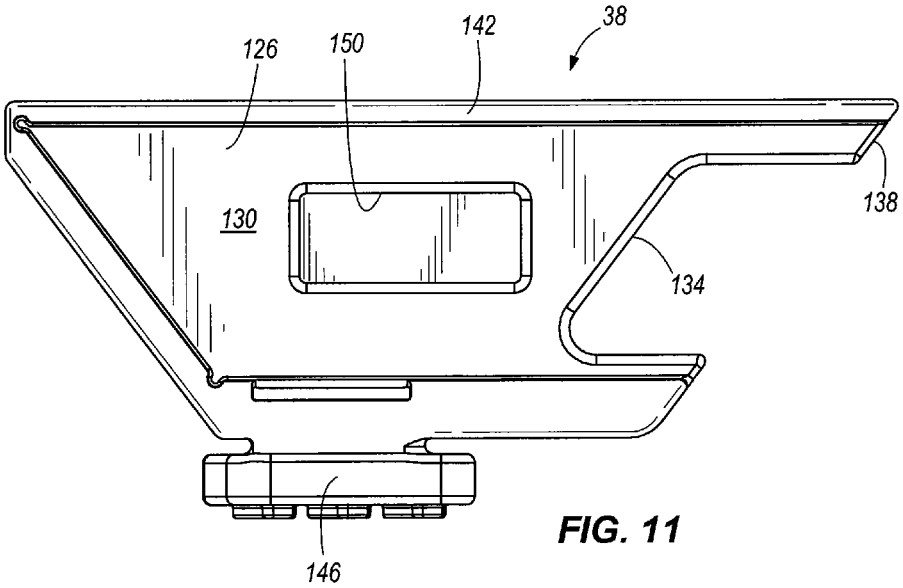
FIG. 11 is a top view of the shuttle of FIG. 10.
Figure 12:
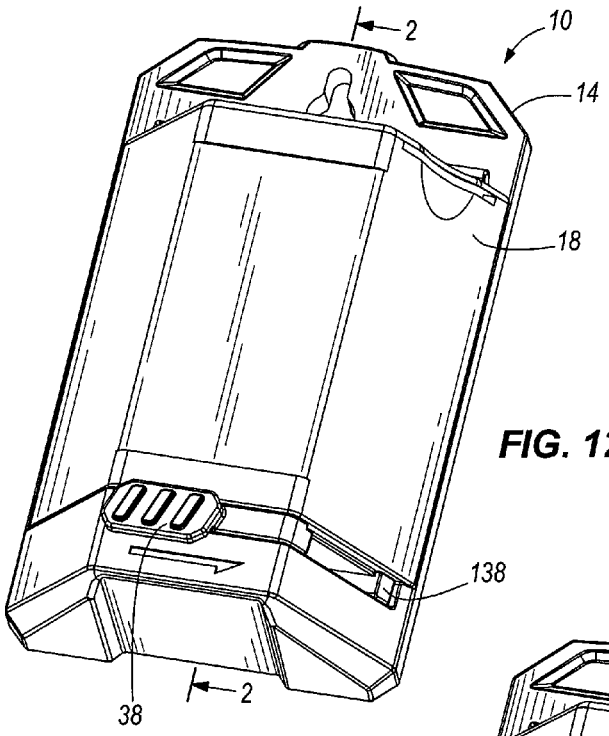
FIG. 12 illustrates the knife blade dispenser of FIG. 1, with the shuttle in a set position.
Figure 13:
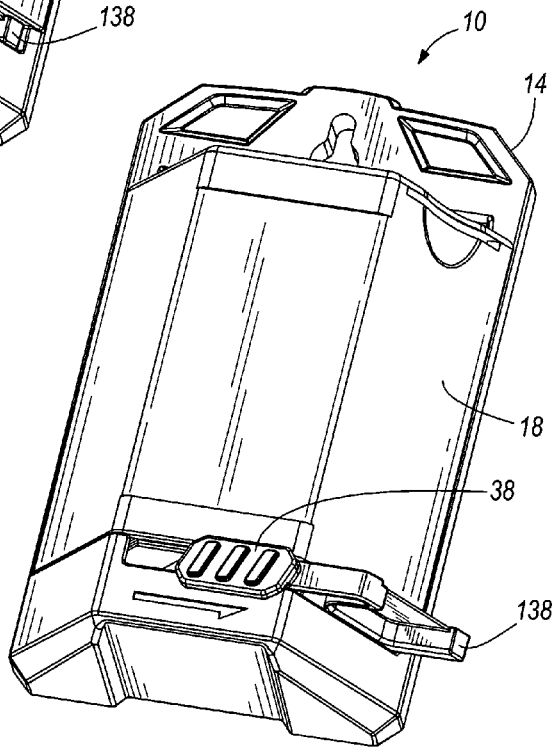
FIG. 13 illustrates the knife blade dispenser of FIG. 1, with the shuttle in a deployed position.

Illustrated in FIGS. 2, 6 and 7, the spacer assembly 26 is positioned and moveable within the storage volume 22 of the knife blade dispenser 10. The spacer assembly 26 is configured to separate the storage volume 22 into a first region 30, in which new knife blades 42*a* are stored, and a second region 34, in which used and worn knife blades 42*b* are stored (FIG. 2). Once assembled, the spacer assembly 26 is moveable along a length of the cover 18 to alter the size of the first and second regions 30, 34. More specifically, as the spacer assembly 26 moves towards the end wall 82 of the cover 18, the first region 30 increases in size while the second region 34 decreases in size. In contrast, when the spacer assembly 26 moves away from the end wall 82, the first region 30 decreases in size while the second region 34 increases in size.

In the illustrated construction, the spacer assembly 26 includes a first end plate 102, a second end plate 106 spaced a distance from the first end plate 102, and a spacer 110 extending therebetween. Each end plate 102, 106 is generally trapezoidal, being sized and shaped to substantially correspond to an inner periphery of the cover 18. Each end plate 102, 106 defines notches 114 extending inwardly from an edge to, when the dispenser 10 is assembled, receive at least a portion of one of the ribs 98 therein. During use, the notches 114 and ribs 98 cooperate to properly position the end plates 102, 106 as the plates move within the storage volume 22. The end plates 102, 106 also include ridges 118 positioned along one or more of the edges to maintain the plates 102, 106 in a substantially perpendicular orientation with respect to the side walls 86 and prevent binding during movement.

Each of the end plates 102, 106 also includes a depression or recess 122 (FIG. 9) formed proximate a center of the corresponding plate, which is sized to receive one end of the spacer 110 therein. When assembled, the recess 122 helps maintain the position of the spacer 110 with respect to the corresponding plate 102, 106. In some constructions, the recess 122 is sized to create a press fit. In other constructions, the spacer 110 is coupled to the end plates 102, 106 by glue or other adhesives. In still another construction, the spacer 110 rests freely within the recess 122.

Best illustrated in FIGS. 2, 6, and 7, the spacer 110 of the spacer assembly 26 is substantially cylindrical in shape having a given length. When assembled, the spacer 110 is positioned between the two end plates 102, 106 to space them a corresponding distance apart from one another. During assembly, in order to increase the distance between the plates 102, 106, a longer spacer (not shown) may be used. In contrast, a shorter spacer may be used to position the plates 102, 106 closer together. In other constructions, the spacer 110 is adjustable in length. Once the spacer 110 having an appropriate length for the number of blades to be stored within the dispenser 10 is selected, new blades are positioned within the cover 18 and the spacer assembly 26 positioned between the blades and the end wall 82.

During use, the spacer assembly 26 takes up a given amount of the storage volume 22 dependent upon the distance between the end plates 102, 106. More specifically, the further the end plates 102, 106 are spaced from one another, the more space the spacer assembly 26 occupies and the less room is left in the storage volume 22 (e.g., in the first region 30 and the second region 34) to receive and store knife blades 42. For example, if the dispenser 10 can store a total of 100 knife blades ($B_{tot}=B_{new}+B_{old}$) within the storage volume 22 when a spacer of length A is used (e.g., the first end plate 102 is spaced a distance A from the second end plate 106). The dispenser would only be able to store a total of 50 knife blades if a spacer of length 2A is used (e.g., the first end plate 102 is spaced twice the distance or 2*A from the second plate 106). In this example, the dispenser 10 would be able to store a total of 125 knife blades if a spacer of length A/2 is used. As such, varying the length of the spacer 110 allows a manufacturer to package different numbers of knife blades within a single dispenser design, limiting the need for specialty packaging.

Furthermore, since the spacer 110 of the illustrated construction has a fixed length, the total number of knife blades 42 that can be stored within the dispenser 10 is constant as the spacer assembly 26 moves within the storage volume 22. For example, if a brand new dispenser 10 contains 100 knife blades (e.g., $B_{new}=100$; $B_{old}=0$; $B_{tot}=100$) and the user dispenses a new blade causing the spacer assembly 26 to shift away from the end wall 82 a distance equal to the thickness of one blade. The amount of space lost in the first region 30 will be equal to the amount of space gained in the second region 34, thus providing the space necessary to store an additional used blade within the second region 34. As such, the overall number of blades within the dispenser 10 does not change as new blades are taken from the first region 30, used, and disposed of in the second region 34 (e.g., $B_{new}=99$; $B_{old}=1$; $B_{tot}=100$).

In the illustrated construction, the spacer assembly 26 is free to move within the storage volume 22 and is generally biased away from the end wall 82 by gravity (assuming the dispenser 10 is mounted in an upright position). However in other constructions, the spacer assembly 26 may be biased by a spring (not shown) or other biasing member towards or away from the end wall 82 as necessary. In still other constructions, a stepping device (not shown) may be used to advance the spacer assembly 26 away from the end wall 82 a given distance each time the shuttle 38 is cycled.

Illustrated in FIGS. 1-2 and 10-11, the shuttle 38 is partially received within and moveable linearly along the grooves 52 formed in the bottom wall 50. The shuttle is movable between a set position (FIG. 12) and a deployed position (FIG. 13) in order to dispense new knife blades 42*a* from the first region 30 of the storage volume 26. In the illustrated construction, the shuttle 38 dispenses a single new knife blade 42*a* each time it is cycled (e.g., the user slides the shuttle 38 from the set position to the deployed position).

The shuttle 38 includes a substantially trapezoidal body 126 having a support surface 130 with a finger notch 134 extending inwardly from a leading edge 138. The shuttle 38 also includes a ridge 142 extending along a portion of the perimeter of the support surface 130. In the illustrated construction, the ridge 142 extends upwardly from the support surface 130 a distance substantially corresponding to a thickness of one knife blade. However, in other constructions, the thickness of the ridge 142 is increased so that the shuttle 38 will dispense multiple blades each time the shuttle 38 is cycled.

The shuttle 38 also includes a handle 146, extending outwardly from the body 126 to provide an easily accessible user interface. In the illustrated construction, the handle 146 includes ridges to increase grip. In other constructions, the handle 146 may be coated in rubber, include knurling, or other coatings and textures to increase friction and allow the user to more easily manipulate the shuttle 38 between the set and deployed positions.

The shuttle 38 also includes magnet 147 (FIG. 2) recessed into the support surface 130 of the shuttle 38 to draw a new knife blade 42*a* towards the support surface 130 and seat it thereon. In the illustrated construction, a single magnet 147 is positioned within a recess 150 proximate a center of the support surface 130 is used. In other constructions, multiple magnets are used. In still other constructions, re-usable adhesive or other forms of attraction may be used when blades formed from alternate materials are used.

To dispense a blade 42*a* from the knife blade dispenser 10, the user begins with a given number of new blades 42*a* in the first region 30 and a given number of old or worn blades 42*b* in the second region 34, with the spacer assembly 26 positioned therebetween. The user biases the shuttle 38 into the set position (FIGS. 1 and 12) causing the support surface 130 to align with the first region 30 of the storage volume 22. Once aligned, the lowermost new blade 42*a* is seated on the support surface 130 of the shuttle 38, being partially pushed by the weight of the blades and the spacer assembly 26 above and partially drawn by the magnet 147 below.

Once the lowermost blade 42*a* is seated on the support surface 130, the user biases the shuttle 38 into the deployed position (FIG. 13) via the handle 146, causing the leading edge 138 of the shuttle 38 to project from the storage volume 22 while carrying the blade 42*a* thereon. The user can then grasp the partially exposed blade 42*a* with the aid of the finger notch 134 and pull the blade out for use. The user then returns the shuttle 38 to the set position completing the cycle.

Once the shuttle 38 has returned to the set position, the next lowermost blade is seated on the support surface 130 as described above causing the spacer assembly 26 to shift downwardly (e.g., away from end wall 82) a distance roughly equal the thickness of one blade. By shifting downwardly, space is opened in the second region 34 as described above.

Once the blade has become worn or a new blade is needed, the user can insert the used blade into the slot 94 formed in the cover 18, causing the blade to enter the newly vacated space in the second region 34 of the storage volume 22. Once all the blades have been removed from the first region 30 and placed in the second region 34 (e.g., all the blades have been used), the user can discard the dispenser assembly 10. In other constructions, the cover 18 may be removable, allowing the user to discard the old cover 18 and replace it with a new cover (not shown) containing a fresh set of blades, or add new blades to the existing cover 18.

The user couples the cover 18 to the frame 14 by aligning each of the protrusions 70 with a corresponding aperture 66, making sure to position the end wall 82 opposite the bottom wall 50. The user then moves the cover 18 towards the frame 14 until each of the protrusions 70 are received within the large ends 74 of the apertures 66. The user then slides the cover 18 towards the bottom wall 50 causing the protrusions 70 to enter the small end 78 of the apertures 66 and become retained therein. As the cover 18 slides into position, the detent 62 is depressed under the end wall 82 until the cover 18 is in place, at which time it snaps outwardly, restricting the cover 18 from being removed.

Figure 14:
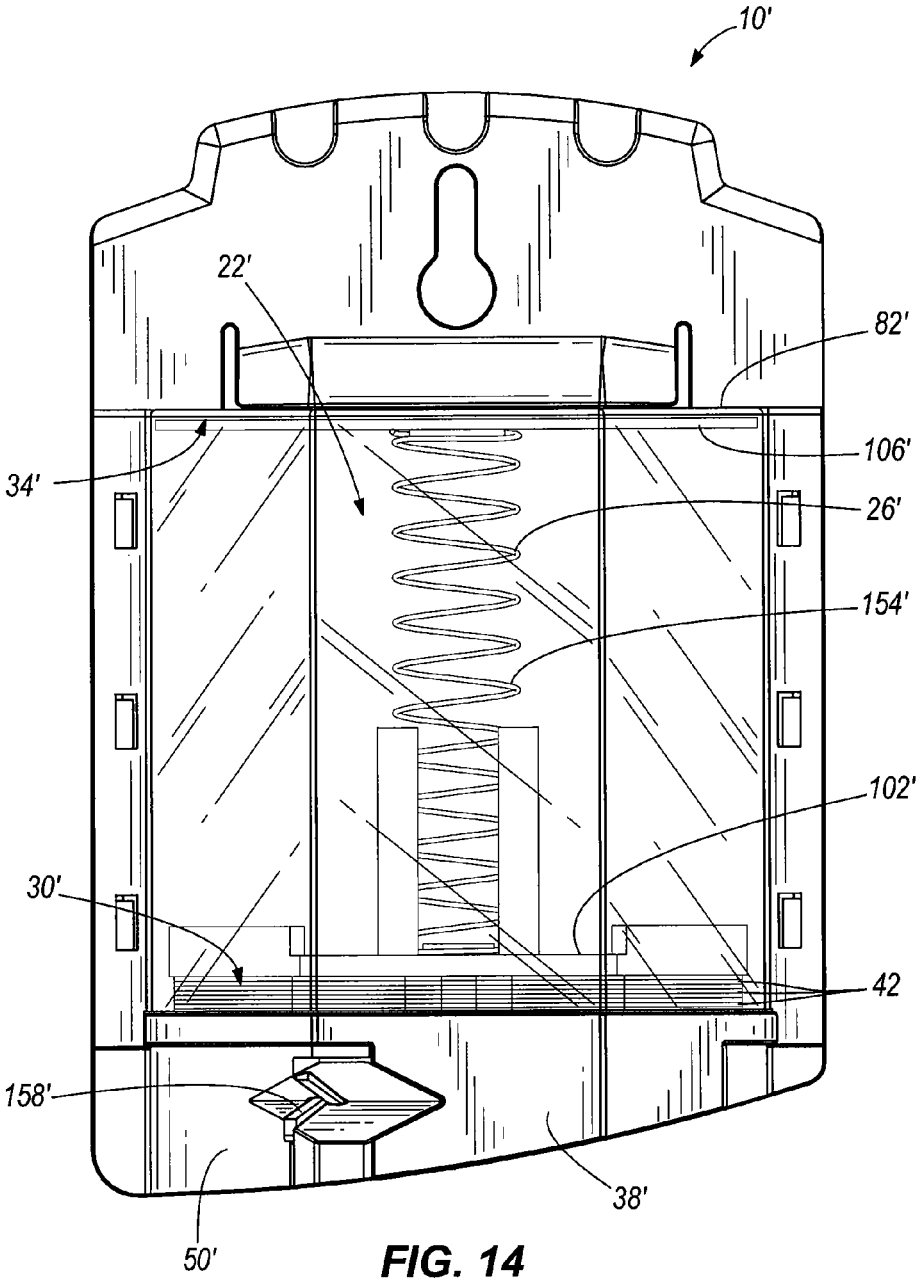
FIG. 14 illustrates a knife blade dispenser according to another construction of the invention.
Figure 15:
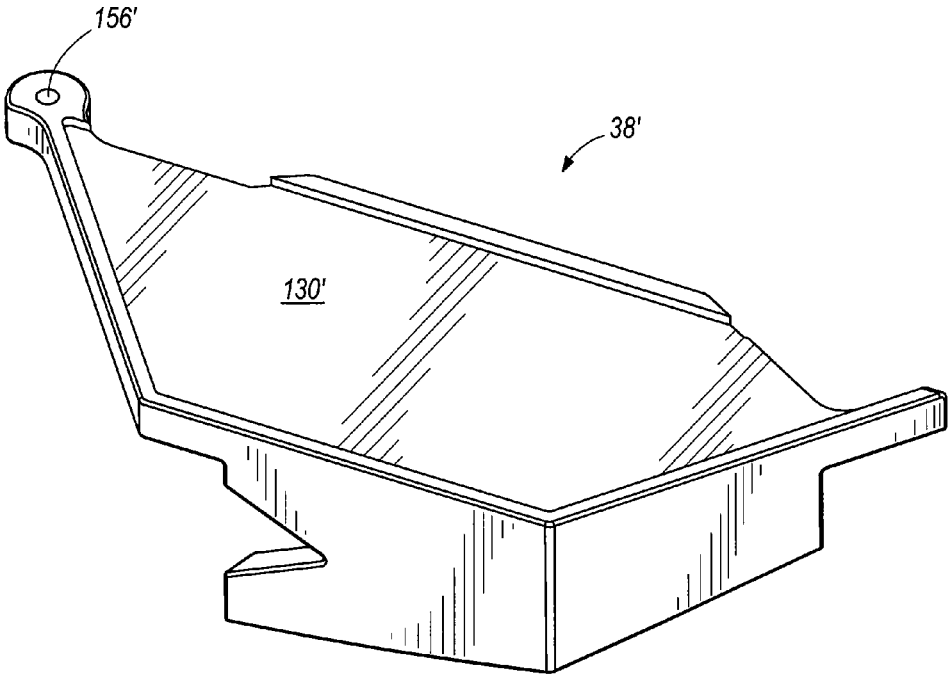
FIG. 15 is a perspective view of a shuttle of the knife blade dispenser of FIG. 14.

FIGS. 14 and 15 illustrate a knife blade dispenser 10' according to another construction of the invention. The knife blade dispenser 10' employs much of the same structure and has many of the same properties as the knife blade dispenser 10 discussed above with respect to FIGS. 1-13. Accordingly, the following description focuses primarily upon structure and features that are different than the previous construction. Analogous elements use the same reference numbers with an added prime (') symbol.

The spacer assembly 26' of the knife blade dispenser 10' includes a first plate 102', a second plate 106' spaced a distance from the first plate 102', and a spring or biasing member 154' extending therebetween. When assembled, the biasing member 154' biases outwardly, biasing the first plate 102' towards the bottom wall 50' and biasing the second plate 106' towards the end wall 82'. Furthermore, the first plate 102' and the second plate 106' are moveable independently of each other within the storage volume 22', taking up and providing space each time a knife blade 42 is added to or removed from the first region 30' and the second region 34', respectively.

Since the distance between the two plates 102', 106' is adjustable, the total number of knife blades that can be positioned within the storage volume 22' is adjustable. More specifically, the user does not have to remove a fresh blade from the first region 30' in order to add a worn blade to the second region 34'. Rather, blades can be added into the second region 34' until the two end plates 102', 106' physically contact one another, the biasing member 154' is completely compressed, or a stop is contacted.

Illustrated in FIG. 15, the shuttle 38' of the knife blade dispenser 10' is pivotably coupled to the frame 14' and rotatable, about a pivot point 156' between a set position, where the support surface 130' is aligned with the first region 30' (FIG. 14) and a deployed position, where the support surface 130' is moved away from the cover 18' (not shown). As described above, the shuttle 38' is configured to dispense a single blade from the first region 30' each time the shuttle 38' is cycled (e.g., rotated from the set position to the deployed position).

Illustrated in FIG. 14, the frame 14' of the dispenser 10' includes a blade sharpener 158'. In the illustrated construction, the blade sharpener 158' includes a pair of steel members positioned at an angle with respect to one another. In alternate constructions the blade sharpener 158' may include a brush such as a brass brush.

Although the invention has been described in detail with reference to certain preferred embodiments, variations and modifications exist within the scope and spirit of one or more independent aspects of the invention as described.

What is claimed is:

1. A knife blade dispenser comprising:

a frame including a back wall and a bottom wall extending outwardly from the back wall, the bottom wall including a groove and the back wall including a locking detent, cover apertures, and a mounting aperture, the mounting aperture configured to hang the dispenser;

a cover including a plurality of protrusions each extending into one of the cover apertures of the frame to couple the cover to the frame to define a storage volume between the cover and the frame for the plurality of knife blades, the cover further including a trapezoidal end wall and three side walls that extend perpendicularly from a periphery of the end wall, a used blade slot located proximate an intersection of the trapezoidal end wall and one of the three side walls, and a rib that extends along an inside surface of at least one of the three side walls, a spacer assembly positioned within the storage volume to separate the storage volume into a new knife blade region for storing a plurality of knife blades and a used knife blade region for storing a plurality of used knife blades that is in communication with the used blade slot, the spacer assembly is movable within in the storage volume along the rib to increase a volume of the used knife blade region while decreasing the volume of the new knife blade region; and a shuttle to dispense at least one of the plurality of knife blades from within the new knife blade region, the shuttle including a projection received in the groove of the frame to guide sliding movement of the shuttle between a set position where the shuttle is located substantially within the storage volume and a deployed position where the shuttle extends at least partially out of the cover to access one of the plurality of knife blades, the shuttle further including a support surface with a finger notch and a ridge that extends around the support surface, the ridge extends upwardly from the support surface a distance substantially corresponding to a thickness of one of the plurality of knife blades;

wherein the spacer assembly includes a first end plate defining an upper boundary of the new knife blade region, a second end plate defining a lower boundary of the used knife blade region and spaced a distance from the first end plate in a direction measured between the used knife blade region and the new knife blade region, and a spacer extending between the first end plate and the second end plate;

wherein the first end plate, the second end plate, and the spacer are separate elements that are assembled together.

2. The knife blade dispenser of claim 1, wherein the cover is in the form of a trapezoidal prism shape.

3. The knife blade dispenser of claim 1, wherein the plurality of protrusions of the cover are L-shaped.

4. The knife blade dispenser of claim 1, wherein the cover includes a pair of ribs that extend along the inside surface of the at least one of the three side walls.

5. The knife blade dispenser of claim 1, wherein the shuttle further includes a magnet recess and a magnet received in the magnet recess.

6. The knife blade dispenser of claim 1, wherein the first end plate and the second end plate are each trapezoidal in shape.

7. The knife blade dispenser of claim 1, wherein the first end plate and the second end plate each include a notch that receives the rib of the cover to guide movement of the spacer assembly within the storage volume.

8. The knife blade dispenser of claim 1, wherein the first end plate and the second end plate each include a recess that receives an end of the spacer to couple the spacer the first end plate and the second end plate.

9. The knife blade dispenser of claim 1, wherein the shuttle further includes a handle configured to provide a user interface to move the shuttle between the set position and the deployed position.

10. A knife blade dispenser comprising:

a frame including a back wall and a bottom wall extending outwardly from the back wall, the bottom wall including a groove and the back wall including a locking detent, cover apertures, and a mounting aperture, the mounting aperture configured to hang the dispenser;

a cover including a plurality of protrusions each extending into one of the cover apertures of the frame to couple the cover to the frame to define a storage volume between the cover and the frame for the plurality of knife blades, the cover further including a trapezoidal end wall and three side walls that extend perpendicularly from a periphery of the end wall, a used blade slot located proximate an intersection of the trapezoidal end wall and one of the three side walls, and a rib that extends along an inside surface of at least one of the three side walls, a spacer assembly positioned within the storage volume to separate the storage volume into a new knife blade region for storing a plurality of knife blades and a used knife blade region for storing a plurality of used knife blades that is in communication with the used blade slot, the spacer assembly is movable within in the storage volume along the rib to increase a volume of the used knife blade region while decreasing the volume of the new knife blade region; and a shuttle to dispense at least one of the plurality of knife blades from within the new knife blade region, the shuttle including a projection received in the groove of the frame to guide sliding movement of the shuttle between a set position where the shuttle is located substantially within the storage volume and a deployed position where the shuttle extends at least partially out of the cover to access one of the plurality of knife blades, the shuttle further including a support surface with a finger notch and a ridge that extends around the support surface, the ridge extends upwardly from the support surface a distance substantially corresponding to a thickness of one of the plurality of knife blades;

wherein the spacer assembly includes a first end plate defining an upper boundary of the new knife blade region, a second end plate defining a lower boundary of the used knife blade region and spaced a distance from the first end plate in a direction measured between the used knife blade region and the new knife blade region, and a spacer extending between the first end plate and the second end plate;

wherein the first end plate and the second end plate each include a recess that receives an end of the spacer to couple the spacer the first end plate and the second end plate.

* * * * *